US012703550B2

(12) United States Patent
Guerrero Gamaza et al.

(10) Patent No.: US 12,703,550 B2
(45) Date of Patent: Aug. 11, 2026

(54) VALVE FOR POURER

(71) Applicant: TORRENT INNOVA, S.L., Cádiz (ES)

(72) Inventors: Jorge Antonio Guerrero Gamaza, Cádiz (ES); Eduardo Jiménez Gálvez, Cádiz (ES)

(73) Assignee: TORRENT INNOVA, S.L., Cádiz (ES)

( * ) Notice: Subject to any disclaimer, the term of this patent is extended or adjusted under 35 U.S.C. 154(b) by 76 days.

(21) Appl. No.: 18/712,258

(22) PCT Filed: Nov. 23, 2021

(86) PCT No.: PCT/ES2021/070841
§ 371 (c)(1),
(2) Date: May 22, 2024

(87) PCT Pub. No.: WO2023/094714
PCT Pub. Date: Jun. 1, 2023

(65) Prior Publication Data

US 2025/0019134 A1 Jan. 16, 2025

(51) Int. Cl.
*B65D 47/06* (2006.01)
*B65D 49/06* (2006.01)

(52) U.S. Cl.
CPC ..... *B65D 49/06* (2013.01); *B65D 47/06* (2013.01)

(58) Field of Classification Search
CPC ..... B65D 49/06; B65D 47/06
See application file for complete search history.

(56) References Cited

U.S. PATENT DOCUMENTS

| | | | | |
|---|---|---|---|---|
| 5,924,606 | A | 7/1999 | Huizing | |
| 6,230,937 | B1 * | 5/2001 | Johnson | B65D 51/28 222/147 |
| 6,854,612 | B2 * | 2/2005 | Thomson | B65D 49/04 222/541.6 |
| 7,398,890 | B2 * | 7/2008 | Thomson | B65D 49/04 215/277 |
| 10,293,992 | B2 | 5/2019 | Zweigart, Jr. et al. | |
| 2016/0229601 | A1 * | 8/2016 | Zweigart, Jr. | B65D 49/04 |

FOREIGN PATENT DOCUMENTS

| | | | |
|---|---|---|---|
| CN | 112478434 | A | 3/2021 |
| GB | 2366287 | A | 3/2002 |

* cited by examiner

*Primary Examiner* — Frederick C Nicolas
(74) *Attorney, Agent, or Firm* — S.J. INTELLECTUAL PROPERTY LTD.

(57) ABSTRACT

An anti-tipping valve for a pourer of containers which including a mechanism for preventing the tipping or manipulation of the position of the valve, the valve being coupled to the mouth of a container; the anti-tipping valve includes a pourer with two cavities connected with one another, and a valve core arranged in both cavities, such that in a closed position of the valve, the valve core is arranged such that it ensures the sealing between both cavities, and in an open position of the valve, the valve core moves inside the valve to thereby ensure a fluid communication between both cavities; the valve includes a transition surface between both cavities to ensure the sealing between both cavities in the closed position of the valve; a configuration of a center of gravity of the valve core is such that, in the closed position, the center of gravity of the core is arranged in one of the cavities and below said transition surface.

22 Claims, 5 Drawing Sheets

VALVE FOR POURER

OBJECT OF THE INVENTION

The present invention relates to an anti-tipping valve for a pourer of containers which comprises means preventing the tipping or manipulation of the position of the valve, the valve is preferably coupled to the mouth of a container.

The present invention is characterized by a valve for a pourer comprising two cavities connected with one another and a valve core arranged in both cavities, such that in a closed position of the valve, the valve core is arranged such that it ensures the tightness between both cavities, and in an open position of the valve, the valve core moves inside the valve to thereby ensure a fluid communication between both cavities.

To ensure the tightness between both cavities in the closed position of the valve, the present invention combines, among others, a transition surface between both cavities and a configuration of the center of gravity of the valve core such that, in the closed position, the center of gravity of the core is arranged in one of the cavities and below said transition surface.

The configuration of the valve results in a device which prevents liquid from entering the bottle closed by the pourer in various situations in which a malicious user seeks to fraudulently refill the bottle using techniques which force the valve core open. These techniques are primarily based on the injection of the fraudulent liquid under pressure into the space of the bottle, and therefore of the valve, by combining various orientations.

BACKGROUND OF THE INVENTION

Valves for the closures of containers, for example bottle-type containers, are means for regulating the passage of fluid from the inside of the bottle to the outside and vice versa. In particular, they must allow the liquid to come out from the inside, but not the other way around. These valves are configured to prevent manipulation or fraudulent refilling of the contents of bottles or containers of great interest in the marketing of high value beverages, for example, bottles intended for liquors.

The valve is configured to allow the passage of a fluid contained in a bottle or container to the outside thereof, that is, the valve opens when tipping the bottle or container and the fluid is allowed to come out. In turn, the valve is configured to prevent said container or bottle from being able to be refilled, that is, preventing a fluid that is injected through a pourer of the bottle or container from reaching the inside of the bottle or container by means of the closure of the valve when the bottle or container is in a vertical position.

Known valves use the weight of the valve core so that the valve opens when the container, together with the valve housed in the pourer, is tilted to favor the exit of the liquid, and this very weight of the core is what tends to close the valve in the vertical position with the pourer oriented upwards.

Throughout the description, relative terms such as up or down will depend on the direction of gravity. A bottle is understood to be in a vertical position when it is oriented according to the direction of gravity.

There are valves in which the weight of the core is not sufficient given that the preferred core manufacturing mode is by plastic injection and plastic has a low density. In this case, the valve includes an additional weight-increasing element. A very common example is the inclusion of a glass ball which is supported on the core when the container with the pourer and the valve are oriented vertically and with the pourer in the upper part. The weight of the ball is exerted on the valve core such that the force with which the valve core is supported on the seat in which sealing is established is greater, complicating the passage of liquid in this position.

Fraudulent techniques which allow refilling the containers with a liquid that is not the original liquid are known even in these conditions. These techniques use elements which introduce the not original liquid under pressure. Either the entire inlet is subjected to pressure, or a conduit which introduces the liquid under pressure is introduced on one side.

The liquid entering with a high entry speed strikes the different surfaces it encounters and particularly the surfaces of moving elements. This is the case of the valve core. Although this liquid entering under pressure does not necessarily lift the valve, with lifting being understood as separating the valve core from its support seat with which sealed closure is established, the tilting of the valve core, establishing the support at only one point, is enough for a gap to be generated on the opposite side of the support seat, with a sealed closure ceasing to exist.

The valve core has parts that are located above the support seat and these parts are those subjected to the forces generated by the entry and impact of the high-pressure incoming liquid.

The present invention relates to a valve for the closure of containers which allows the preceding problems to be solved by means of a specific configuration and combination of components which ensure the closure of the valve, and accordingly the tightness thereof, thereby preventing the container from being able to be refilled even by means of techniques for the forced introduction of a fraudulent liquid under pressure.

DESCRIPTION OF THE INVENTION

The invention solves the problems identified above with a valve for a pourer of containers and a closure for bottles. The dependent claims define specific embodiments of the valve.

A first inventive aspect of the invention defines a valve for a pourer of containers being configured to be coupled to the mouth of a container according to an axial direction X-X' such that, when the pourer is in an operative mode coupled to the container, the lower part is on the side next to the container and the upper part is on the side farther away from the container.

Axial direction X-X' is the main longitudinal direction of the mouth of the container and also the main direction followed by the actual valve or the pourer with a valve when it is coupled in the mouth of the container.

Position- and orientation-related terms such as upper, lower, deep area, etc., will be used. These position-related terms shall be interpreted with respect to the orientation adopted by a container with its mouth located in the upper part, where the pourer is coupled with the valve in question, and all these terms refer to the direction of gravity, as indicated above.

Operative mode shall be understood as when the pourer is coupled to the container, such that the valve is coupled to the mouth of the container. In this operative mode position of the pourer, lower part shall be understood as the part which is on the side closer to the container and upper part as the part which is on the side farther away from the container.

The present valve comprises a frame comprising:

a first cavity having a tubular configuration with the main axis thereof oriented according to the axial direction X-X' with a passage opening, and a second cavity having a tubular configuration with the main axis thereof oriented according to the axial direction X-X' and in communication with the first cavity through the passage opening, the second cavity comprising a cylindrical guiding surface extending according to the axial direction X-X', and a sealing flange projecting towards the inside of the second cavity.

Following the axial direction X-X', the invention comprises a frame made up of a first tubular cavity concentric to the axial direction X-X' and with a passage opening, and an also tubular second cavity concentric to the axial direction X-X'. Both the first cavity and the second cavity are in communication through the passage opening arranged between both cavities. In turn, the second cavity comprises a cylindrical guiding surface extending according to the axial direction X-X'. "Cylindrical surface" shall be understood as the surface which is generated by revolution from a generatrix rotated about the axial direction X-X'. In a particular example, the cylindrical surface is a conical surface. The generatrix can also be a curve, resulting in a tubular body with curved surfaces. According to this interpretation, a cylinder is a cylindrical surface where the generatrix is a line parallel to the axis of revolution, the axis which determines the axial direction X-X'.

Furthermore, the second cavity comprises a sealing flange understood as a projection of the second cavity towards the inside thereof, i.e., towards the inside of the frame.

The sealing flange is where the valve core is supported, giving rise to the sealed closure thereof.

The second cavity is characterized in that it comprises a diameter smaller than the diameter of the first cavity and both cavities are connected by means of an inner transition surface located in the first cavity. In particular, the inner transition surface of the first cavity is in direct connection with the cylindrical guiding surface of the second cavity.

The valve further comprises a valve core arranged inside the frame and comprising:

a first guiding segment adapted for being housed on the guiding surface of the second cavity, and a support surface adapted for being supported on the sealing flange, the support surface adapted to establish tightness between both surfaces.

The valve core is arranged inside the frame between both cavities and comprises a first guiding segment and a support surface, such that the guiding surface of the second cavity is configured for guiding the valve core, and particularly its first guiding segment. Guiding is in accordance with the axial direction X-X', also ensuring the concentric position between the core and the frame. The sealing flange is suitable for receiving the support surface of the valve core. When the support surface of the valve core is supported on the sealing flange of the second cavity, sealing is established between both surfaces, and therefore between the first cavity and the second cavity, thereby preventing the passage of fluids from one cavity to another, that is, closing the passage opening of the first cavity.

The valve further comprises at least two main positions.

A first closed position in which the first cylindrical segment of the valve core is housed on the guiding surface of the second cavity and the support surface of the valve core is supported on the sealing flange, establishing sealing between both surfaces and thereby establishing sealing between the first cavity of the frame with respect to the second cavity of the frame.

This first closed position corresponds to the position of the valve in which tightness between both cavities of the frame is ensured, and this means that the passage of fluids from one cavity to another, particularly of fluid which may be fraudulently introduced, is prevented.

A second open position in which the support surface of the valve core is separated from the sealing flange in at least one point, giving rise to a fluid communication passage between the first cavity of the frame with respect to the second cavity of the frame.

In this second open position, the passage opening of the first cavity to the second cavity is free in at least one point as a result of the support surface of the valve core separating in at least one point from the sealing flange of the second cavity. That is, in this second open position, the passage of fluids from one cavity to another is allowed.

The valve core is characterized by comprising a configuration such that its center of gravity is, according to the axial direction X-X' and when the valve is in its first closed position, in the second cavity and below the inner transition surface.

In the operative mode of the pourer when it is coupled to the mouth of a container, the present valve ensures tightness between both cavities of the valve, i.e., the possibility of fraudulently introducing fluids or refilling the container through the valve is completely reduced. This is due to the configuration of the first cavity and the second cavity of the valve frame and to the actual configuration of the valve core.

In the closed position of the valve, tightness between its cavities is ensured, and in its open position, the passage of fluids which corresponds to the contents of the container being poured or released through the valve, is allowed. When the container is tipped with the pourer in an operative mode coupled to the mouth thereof, the fluid contained inside the container presses the valve core in at least one point to move it to the second cavity and thereby causing the opening of the valve. In contrast, when the container is in a vertical position, that is, contrary to the tipping of the inside thereof, the valve is closed and the passage of fluids to the inside of the container is blocked, and the possibilities of refilling the inside of the container are thereby reduced.

The guiding surface of the second cavity ensures the guiding of the valve core, and consequently the correct position and adjustment thereof in the housing defined by said guiding surface and the sealing flange. Once the valve core is supported on the sealing flange, particularly when the entire support surface thereof is supported on this flange, the valve is closed, giving rise to the tightness between both cavities.

In this same position, when an attempt is made to forcefully introduce a fluid through the pourer, although the fluid impacts an accessible portion of the valve core in the first cavity, it does not particularly impact the first guiding segment since it is housed on the guiding surface. Likewise, given that no rotational torques which tilt the core are generated, the support surface remains supported on the sealing flange as a result, thereby preventing the destabilization of the valve core and ensuring that this fluid to be introduced does not go through the first cavity to the second cavity, and from there into the container.

In turn, the fact that the center of gravity of the valve core is arranged in the second cavity and below the inner transition surface of the first cavity when the valve is in its closed position increases the stability of the valve core, improving its behavior when receiving the impact of a fluid to be fraudulently introduced.

Accordingly, the combination of the guiding segment of the core being housed, and thereby protected, on the guiding surface of the second cavity, along with the configuration of the center of gravity of the core itself, ensures tightness between the cavities of the valve in its closed position even in the adverse conditions imposed by the introduction of a fraudulent fluid under pressure, even when the fluid hits to a greater extent only one side of the valve core.

Therefore, the present valve advantageously ensures tightness therein and thereby reduces the possibilities of refilling the inside of a container through the pourer.

In a particular embodiment, the center of gravity of the valve core is below a plane transverse to the axial direction X-X' containing the support surface.

The support surface of the valve core is the surface of the core intended to be supported on the sealing flange of the second cavity when the valve is in its first closed position. This support surface of the valve core is comprised in a plane which is perpendicular to the axial direction X-X'. In turn, in a particular embodiment, the sealing flange of the second cavity is comprised in a plane which is also perpendicular to the axial direction X-X'. The fact that both the support surface of the core and the sealing flange are both comprised in a plane transverse to the axial direction X-X' and that this transverse plane is located above the center of gravity of the valve core means that the center of gravity has the natural tendency of ensuring axial orientation, even in the presence of external actions such as the action of the incoming fluid acting on the valve.

In a particular embodiment, the first guiding segment of the valve core is below the inner transition surface when the valve is in its first closed position.

The valve is internally configured so that the first guiding segment of the core is arranged below the inner transition surface of the first cavity according to the axial direction X-X' when the valve is in its first closed position. Particularly, this prevents, when a fluid is introduced under pressure through the inside of the pourer comprising the present valve in an attempt to fraudulently refill the container, this fluid entering under pressure from impacting the first guiding segment of the valve core and destabilizing it, given that this impact will have a transverse component which generates a rotational torque with respect to the support. That is, since the first guiding segment of the core is housed in the cylindrical guiding surface of the second cavity and below the inner transition surface of the first cavity, it is completely protected from being destabilized by the flow entering under pressure into the valve, and accordingly tightness is ensured therein, preventing the passage of the fluid from the first cavity to the second cavity even though the fluid enters under pressure.

In a particular embodiment, the first guiding segment of the valve core comprises a perimetral surface fitting snugly against the guiding surface of the frame.

Advantageously, this configuration between surfaces ensures the correct arrangement of the valve core inside the frame, particularly ensuring that both parts remain concentric, as well as preventing direct access of any fluid introduced under pressure from the first cavity to the second cavity and vice versa when the valve is in the closed position. In other words, the fact that the surface of the first guiding segment of the core fits snugly against the guiding surface of the frame ensures that there is no passage between the cavities of the valve for flows entering as a result of a fraudulent attempt to refill the container under pressure.

In a more particular embodiment, the valve core comprises a bevel surface between the perimetral surface and the support surface.

This bevel surface has several effects, the first effect is to generate a space which allows preventing the valve core from being supported in a region where liquid waste with high sugar contents may appear. Likewise, although these deposits are not produced, it is favorable for the support to be on the flat transverse surface of the valve core and not at an edge, which would be the case if the beveled surface is not present, ensuring a more robust closure.

In a particular embodiment, the guiding surface is located according to the axial direction X-X' between the sealing flange and the inner transition surface of the first cavity.

According to a preferred example, the guiding surface has a cylindrical configuration. This configuration ensures the guiding of the valve core according to the axial direction in any operative position of the core, although it is separated. It also ensures the co-axiality of the valve core with respect to the seat which ensures tightness even before reaching the closed position. Even though it is not cylindrical, the surface generates a lateral protection of the valve core such that any flow forced under pressure to fraudulently refill the container will be guided through the inner transition surface of the first cavity but will not strike a surface with transverse orientation as a result of the presence of the guiding surface.

In a particular embodiment, the first guiding segment has a configuration:

- that is cylindrical, or
- conical, or
- that combines at least one cylindrical segment and at least one conical segment.

In a particular embodiment, the guiding surface has a configuration:

- that is cylindrical, or
- conical, or
- that combines at least one cylindrical segment and at least one conical segment.

In a particular embodiment, the first guiding segment has a complementary configuration with respect to the guiding surface. Advantageously, the introduction of the valve core into the frame is facilitated, and the accommodation of the core in the frame in the closed position of the valve is also facilitated. In turn, this configuration facilitates the movement of the valve core inside the frame from the closed position to the open position and vice versa.

Cylindrical configurations establish a good protection against transverse flows caused by a forced entry of fluid in a fraudulent refilling attempt. Conical configurations give rise to ease of opening without wedging and facilitate the removal of injection molds.

In a particular embodiment, the inner transition surface is a surface transverse to the axial direction X-X'.

According to this configuration, a flow forcefully introduced in the pourer according to the axial direction is horizontally deflected, causing a significant head loss and preventing the flow from subsequently striking the moving part of the valve, that is, the valve core, with high energy. The position above the main elements of the valve core also prevents the deflected fluid from generating a rotational torque which would cause the opening of the valve.

In a particular embodiment, the valve core further comprises:

- a second segment which is concentric with respect to the first guiding segment;

a fluid storage cavity limited according to a radial direction between the first guiding segment and the second segment, and in the lower portion thereof by a base;

wherein the storage cavity is located below the inner transition surface when the valve is in its first closed position.

With this configuration of the valve core comprising a fluid storage cavity, it is ensured that if a fluid is introduced into the frame by means of the first cavity in the closed position of the valve, said fluid first flows over the transition surface, flooding the first cavity of the frame of the valve and being introduced in the fluid storage cavity until it impacts the second segment of the valve core. As the fluid storage cavity is being filled, the weight of the valve core gradually increases, and this ensures that the core is not destabilized or tilted as a result of the impact of the fluid introduced in the valve.

The fluid filling the storage cavity generates a region close to stagnant conditions, so they cause the effect of generating an additional surface for deflecting any transverse flow that would otherwise produce a rotational torque that tends to tilt the valve core.

Furthermore, not only the weight of the valve core increases, rather the center of gravity of the core below the support surface thereof according to the axial direction X-X' is also moving. Accordingly, the passage of the fluid from the first cavity to the second cavity of the frame of the valve when it is in its closed position is completely prevented.

In a more particular embodiment, the second segment extends above the first guiding segment according to a curved deflector curved segment in an upward direction towards a central axis of the valve core parallel to the axial direction X-X'. In particular, the curved deflector curved segment is the exposed part of the second segment of the core which acts as a deflector for deflecting the fluid when it is introduced into the valve and impacts the valve core, achieving the core being driven to the second cavity and not the opposite. Advantageously, the stability of the valve core in the closed position of the valve is thereby ensured.

In a particular embodiment, the first guiding segment comprises a first upper surface contained in a first plane transverse to the axial direction X-X', and wherein the second segment comprises a second upper surface contained in a second plane transverse to the axial direction X-X', the first plane being located below the second plane.

According to this configuration, the more elevated area corresponds to the second segment, therefore the fluid forcefully entering under pressure due to an attempt to fraudulently refill the container will strike a smaller transverse segment, minimizing the tendency to tip over, because the second guiding segment is at least partially shielded by at least the height of the first guiding segment.

In a particular embodiment, the valve core further comprises a plurality of tabs arranged in the fluid storage cavity and thereby splitting said fluid storage cavity into sectors.

These tabs advantageously prevent the rotating fluid from impacting the valve core in this region, particularly the storage cavity, also favoring the presence of a stagnant region.

In a particular embodiment, the valve core comprises a seat in its upper part for supporting a ball intended for increasing the weight exerted on the valve core.

In particular, the seat is located on the second segment of the core and concentric to the axial direction X-X'. This seat is configured for receiving one or more balls with a weight exerting a weight force on the valve core to thereby ensure the stability of the core in the closed position of the valve in the event that it receives the impact of a fluid with which a container is to be refilled.

In a particular embodiment, the valve core comprises a plurality of circularly distributed, downwardly oriented prolongations.

These prolongations are circularly oriented downwards according to the axial direction X-X', that is, towards the second cavity of the frame of the valve and allow, among other effects, lowering the position of the center of gravity of the valve core.

In a more particular embodiment, the frame comprises a flange oriented towards the inside of the second cavity adapted for being located between two prolongations of the valve core limiting the rotation thereof in order to provide greater stability to the valve core.

That is, since the flange is arranged between two prolongations, the rotation of the valve core is prevented, and its stability is increased primarily in the closed position of the valve.

In a particular embodiment, the prolongations have beveled ends, said beveled ends being oblique and oriented in the same circular direction to cause a rotational force in light of the impact of the liquid when it tries to come out through the valve from the lower part thereof.

Many liquors, the high-value flow stored in the bottle, contain a high concentration of sugars which may precipitate or dry up, causing the adhesion of the surfaces of parts movable with respect to one another. This is the case of the valve core and the frame. If this occurs, when the bottle is tilted in a pouring position, the liquid impacts the bevel edges, generating a rotational torque about an axis parallel to the axial direction X-X'. Although the rotation is limited due to the presence of flanges between prolongations which prevent rotation, these prolongations prevent significant rotations but offer spaces with significant clearance that allow a small rotation which is sufficient to cause the valve core to become detached from the frame.

In a particular embodiment, the frame further comprises a first outer surface configured for being in contact with the inside of the element, preferably a pourer, on which the valve is coupled according to the axial direction X-X'.

When the present valve is coupled or arranged in a pourer of a container or bottle, this is done by means of the first outer surface of the valve coming into contact with the inside of the pourer, ensuring tightness between both parts. Preferably, the material of the frame has a Young's modulus that is smaller than the Young's modulus of the pourer, therefore allowing a greater degree of deformation to ensure a sealed attachment between the frame and the pourer.

In a particular embodiment, the frame further comprises a second outer surface configured for being supported on and establishing sealing with the inside of the mouth of the container.

That is, when the valve is coupled on the mouth of a container or bottle, this is done by means of the second outer surface coming into contact with the inside of the mouth of the container, with the valve thereby being supported on the mouth of the container and providing sealing between them. According to the axial direction X-X' and in the closed position of the valve, the second outer surface of the frame of the valve is arranged below the first outer surface thereof.

In a particular embodiment, the frame further comprises a beveled surface arranged between the inner transition surface and the guiding surface.

This beveled surface which slants towards the second cavity or the axial direction X-X' means that the fluid seeping into the first cavity is deflected and flows from the inner transition surface to the valve core, thereby reducing the impact thereof inside the frame of the valve.

In a particular embodiment, the frame further comprises a plurality of guiding tabs arranged in the first tubular cavity.

Besides increasing the rigidity of the assembly, these tabs prevent the presence of velocity components of the incoming flow in the event of the forced introduction thereof which tends to cause the flow to rotate about an axis parallel to the axial direction X-X'.

In a second inventive aspect, the present invention proposes a closure for bottles comprising a valve according to the first inventive aspect.

DESCRIPTION OF THE DRAWINGS

These and other features and advantages of the invention will be more clearly understood based on the following detailed description of a preferred embodiment given solely by way of non-limiting illustrative example in reference to the attached figures.

DETAILED DESCRIPTION OF THE INVENTION

The present invention describes a valve for a pourer of containers, preferably bottles containing high-value liquors, which is configured for being coupled to the mouth of a container according to an axial direction X-X'. It will be understood that the pourer is in the operative mode when it is coupled to a container such that the lower part of the valve is on the side next to the container and the upper part of the valve is on the side farther away from the container.

Figure 1:
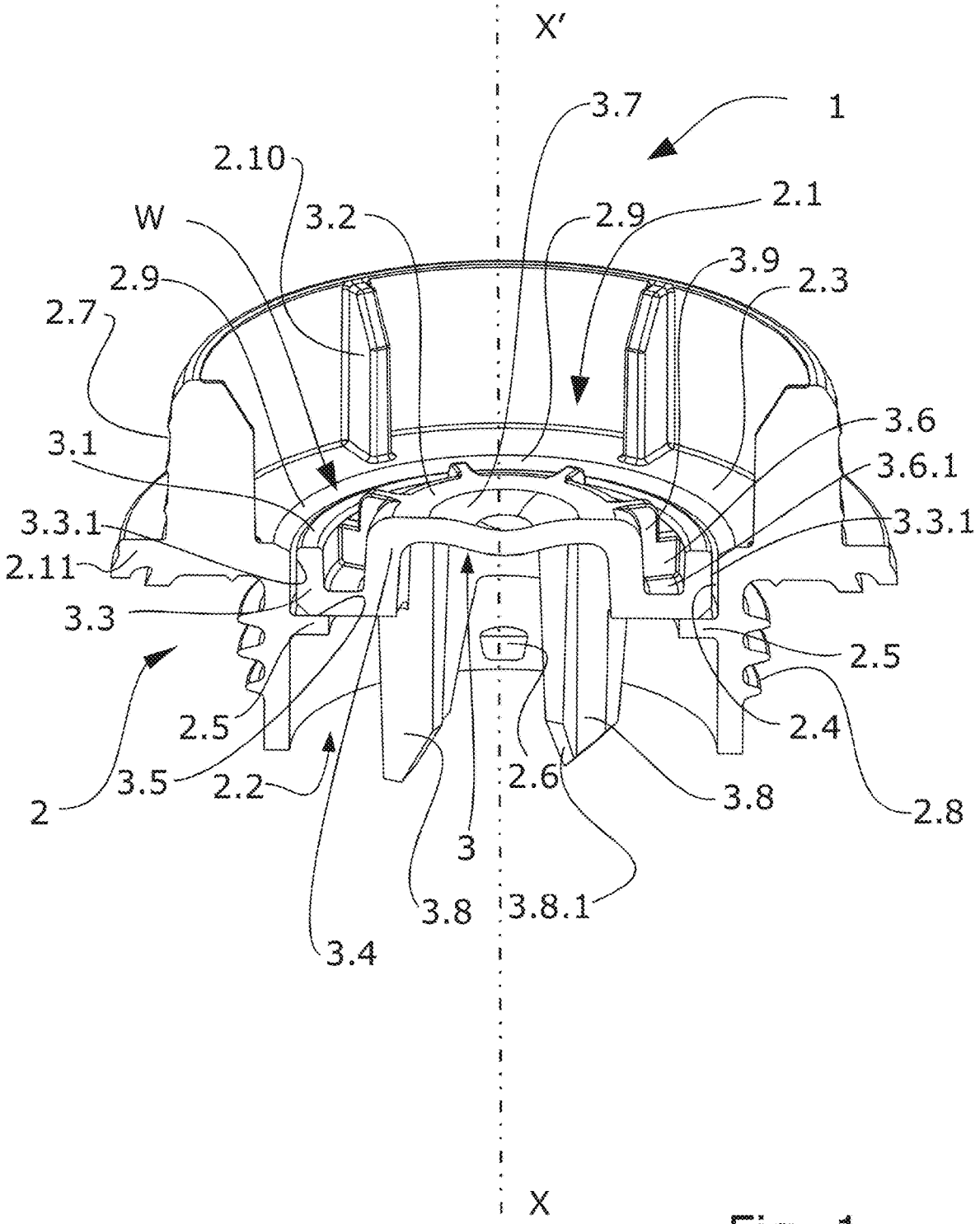
FIG. 1 This figure shows a sectional view of an embodiment of the valve in a first closed position according to an embodiment of the present invention.

FIG. 1 shows a particular example of a valve (1) according to the present invention, particularly a lateral section of the valve (1) in question. This valve (1) is primarily formed by a frame (2) or main body and a valve core (3) which is housed inside the frame (2). The valve (1) is primarily characterized by comprising at least two positions, a first closed position blocking the passage of fluid through the inside thereof, and a second open position allowing the passage of fluid, specifically from the lower part to the upper part of the valve (1).

Figure 3:
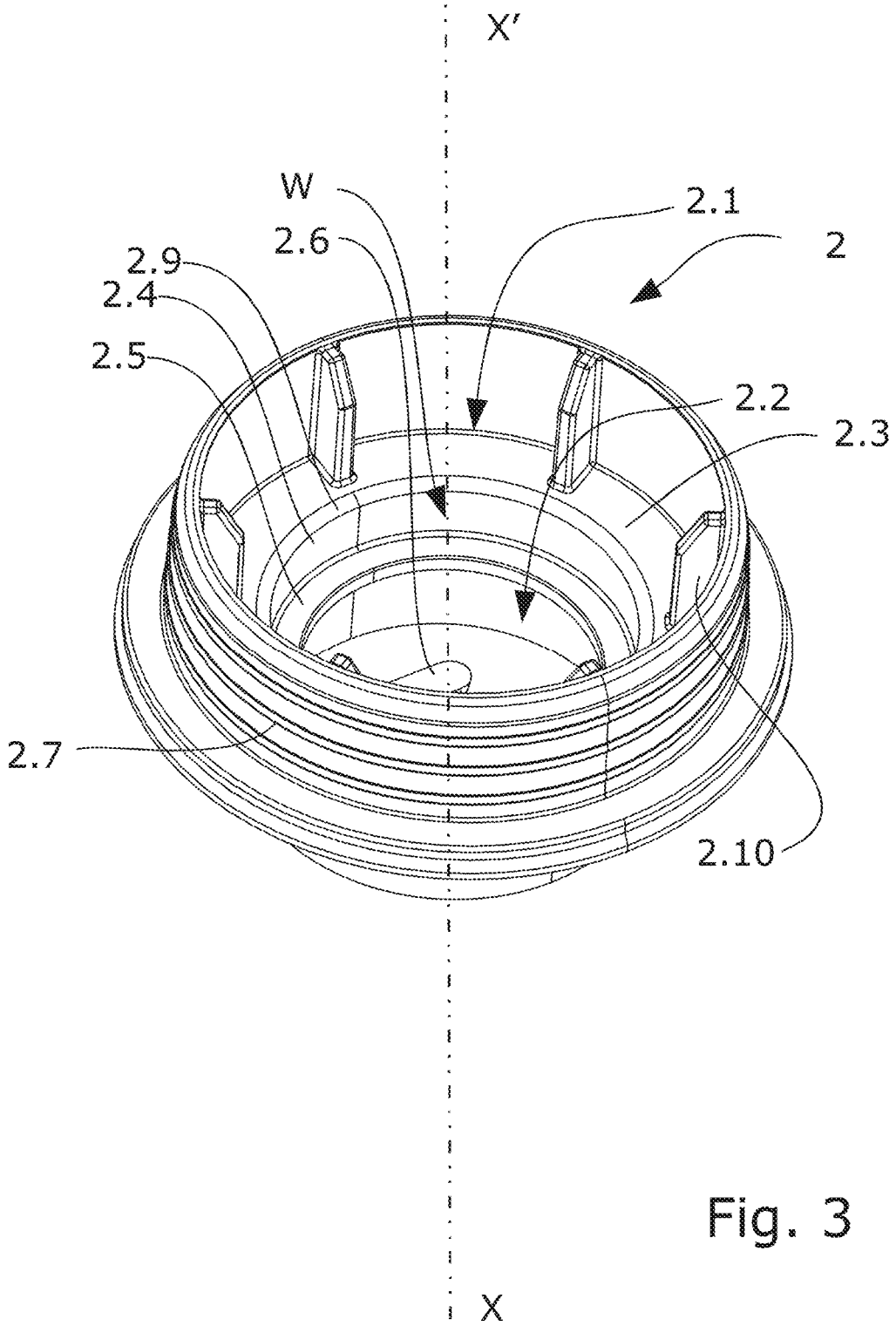
FIG. 3 This figure shows a top perspective view of the frame of the embodiment of the valve of FIG. 1.

In particular, the frame (2) comprises two cavities therein, a first cavity (2.1) and a second cavity (2.2). The first cavity has a tubular configuration with a main axis oriented according to the axial direction X-X' and comprises an opening (W). On the other hand, the second cavity (2.2) also has a tubular configuration with the main axis thereof oriented according to the axial direction X-X'. The second cavity (2.2) is in communication with the first cavity (2.1) by means of the passage opening (W). FIG. 3 specifically shows the tubular configuration of the frame (2) of the valve (1) shown in FIG. 1. Particularly, both the first cavity (2.1) and the second cavity (2.2) of the frame (2) are concentric to the axial direction (X-X'), but the diameter of the second cavity (2.2) is smaller than the diameter of the first cavity (2.1).

Both cavities (2.1, 2.2) are connected by means of an inner transition surface (2.3) running from the inner wall of the first cavity (2.1) to the inner wall of the second cavity (2.2). In particular, the inner transition surface (2.3) is arranged in the first cavity (2.1). As can be seen in FIGS. 1 and 3, the inner transition surface (2.3) is a surface transverse to the axial direction X-X'.

The second cavity (2.2) in turn comprises a cylindrical guiding surface (2.4) which is concentric to the axial direction X-X' and the main axis thereof is therefore parallel to this same direction; and a sealing flange (2.5) projecting from the frame towards the inside of the second cavity (2.2). In particular, the sealing flange (2.5) is contained in a plane which is perpendicular to the axial direction X-X'. Furthermore, the cylindrical guiding surface (2.4) is arranged as a downward continuation, that is, according to the axial direction X-X', of the inner transition surface (2.3) of the first cavity (2.1), the cylindrical guiding surface (2.4) being arranged between the sealing flange (2.5) and the inner transition surface (2.3) of the first cavity (2.1).

FIGS. 1 and 3 show how the guiding surface (2.4) of the second cavity (2.2) has a cylindrical configuration. In another example (not shown), the guiding surface (2.4) has a conical configuration or a combination of at least one cylindrical segment and at least one conical segment.

As shown in FIGS. 1 and 3, the frame (2) also comprises a flange (2.6) which is oriented towards the inside of the second cavity (2.2). Particularly, this flange (2.6) is a narrow element projecting towards the inside of the frame (2) in the second cavity (2.2) as seen in detail in FIG. 3.

Furthermore, the frame (2) comprises a beveled surface (2.9) arranged between the inner transition surface (2.3) and the guiding surface (2.4). This beveled surface (2.9) causes the fluid seeping into the first cavity (2.1) and coming into contact with the inner transition surface (2.3) to be deflected to the center of the inside of the frame (2).

Moreover, the valve (1) comprises a core or valve core (3) which is housed inside the frame (2). Primarily, this core (3) has a first guiding segment (3.3) and a support surface (3.5). The first guiding segment (3.3) is adapted for being housed on the guiding surface (2.4) of the second cavity (2.2); whereas the support surface (3.5) is adapted for being supported on the sealing flange (2.5) also of this second cavity (2.2) and thereby providing a sealed closure between both the flange surface (2.5) and the support surface (3.5).

In particular, the first guiding segment (3.3) of the core (3) comprises a perimetral surface (3.3.1) fitting snugly against the guiding surface (2.4) of the frame (2), such that the core (3) is accommodated inside the frame (2) and fits snugly against the guiding surface (2.4) in the second cavity (2.2). Particularly, the core (3) has a beveled surface between the perimetral surface (3.3.1) and the support surface (2.5) of the frame (2).

As seen in FIG. 1, the guiding segment (3.3) of the valve core (3) has a cylindrical configuration. In another example (not shown), the guiding segment (3) has a conical configuration or combines at least one cylindrical segment and at least one conical segment. Furthermore, as can be seen in this figure, the first guiding segment (3.3) is complementary with the guiding surface (2.4) of the second cavity (2.2), such that it allows the core (3) to be housed in the second cavity (2.2) particularly between the guiding surface (2.4) and the sealing flange (2.5).

FIG. 1 shows, in particular, the first closed position of the valve (1). In this first closed position, the first cylindrical segment (3.3) of the core (3) is housed on the guiding surface (2.4) of the second cavity, and the support surface (3.5) of the core is supported on the sealing flange (2.5) thereby establishing tightness between the first cavity (2.1) and the second cavity (2.2). On the other hand, the second open position of the valve (1) (not shown in the figures) is that in which the support surface (3.5) of the core is separated from the sealing flange (2.5) in at least one point, thereby allowing fluid communication between the first cavity (2.1) and the second cavity (2.2).

In particular, the present valve (1) is characterized by having a configuration such that the center of gravity of the valve core (3) is, according to the axial direction X-X', in the second cavity (2.2) of the frame (2) below the inner transition surface (2.3) when the valve (1) is in its closed position. That is, as a result of the configuration of the frame (2) and of the core (3), and also as a result of the position of the center of gravity of the core (3), when the valve (1) is in its first closed position, sealing between the first cavity (2.1) with respect to the second cavity (2.2) is ensured, thereby preventing this container from being able to be refilled when the valve (1) is coupled to a pourer of containers.

In a particular example, the center of gravity of the valve core (3) is below a plane transverse to the axial direction X-X' containing the support surface (2.5) of the frame (2).

As can be seen in FIG. 1, the first guiding segment (3.3) of the core (3) is arranged below the inner transition surface (2.3) in the closed position of the valve (1).

The valve core (3) in turn comprises a second segment (3.4) which is concentric with respect to the first guiding segment (3.3), that is, concentric according to the axial direction X-X'. The core (3) also comprises a fluid storage cavity (3.6) which is limited, according to a radial direction, between the first guiding segment (3.3) and the second segment (3.4), and in the lower portion thereof by a base (3.6.1) also of the core (3). This fluid storage cavity (3.6) allows the fluid seeping into the first cavity (2.1) of the valve (1), in an attempt to refill the inside of a container, going from the first cavity (2.1) to the second cavity (2.2), and therefore to the inside of the container, to flow until reaching said storage cavity (3.6) where said fluid is housed and floods not only the storage cavity (3.6) but also the first cavity (2.1), such that it increases the weight of the core and thereby assures the stability thereof in the first closed position of the valve (1).

As seen in FIG. 1, the storage cavity (3.6) of the core (3) is located below the inner transition surface (2.3) in the first closed position of the valve (1). More particularly, the fluid storage cavity (3.6) comprises a plurality of tabs (3.9) splitting said storage cavity (3.6) into sectors as can be seen in detail in FIGS. 1 and 4.

Figure 4:
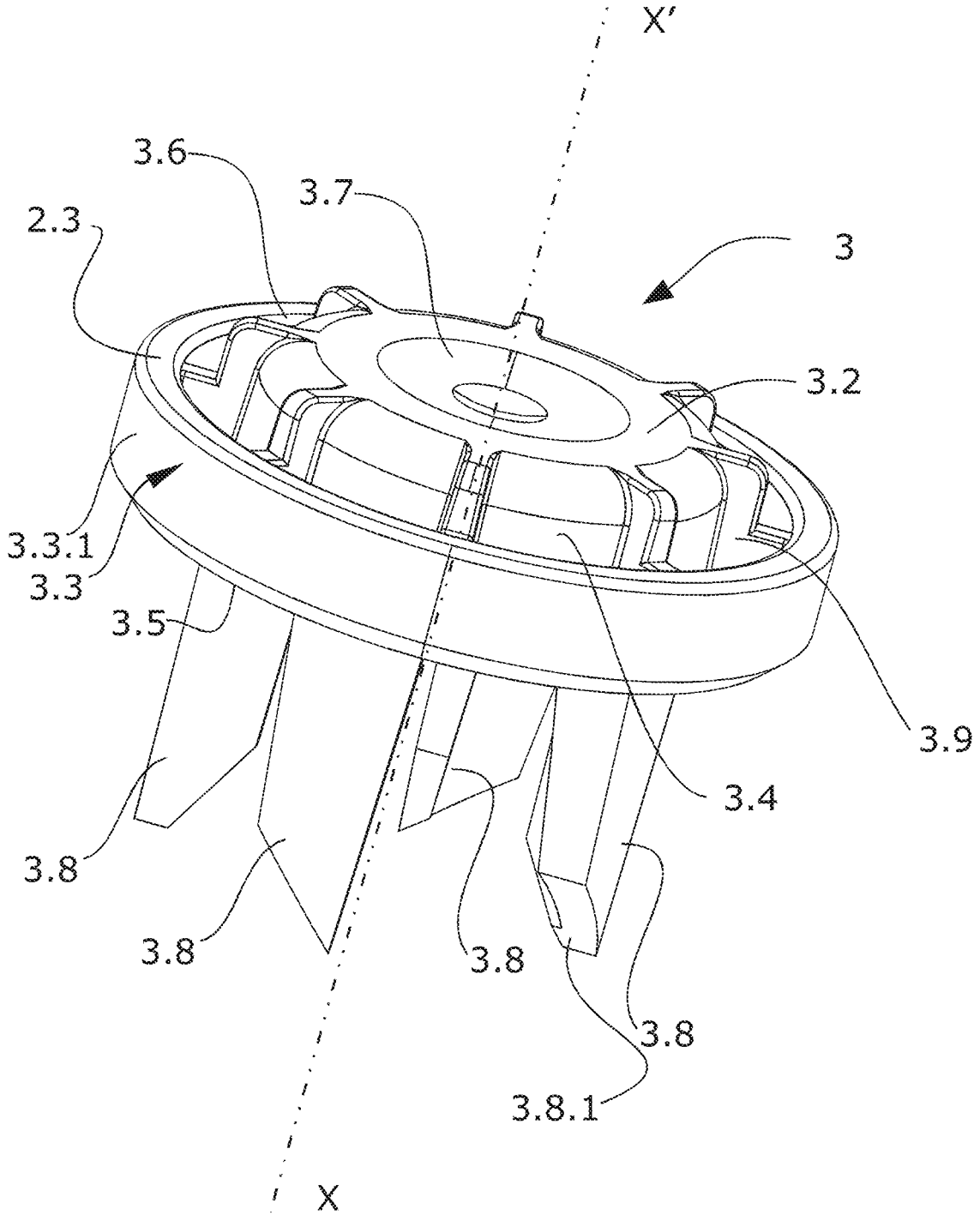
FIG. 4 This figure shows a perspective view of the core of the embodiment of the valve of FIG. 1.

Furthermore, as can be seen in FIG. 1 and in detail in FIG. 4, the second segment (3.4) of the core extends above the first guiding segment (3.3) by means of a curved segment acting as a deflector and curved in an upward direction towards a central axis of the valve core (3) parallel to the axial direction X-X'. This curved segment is configured to deflect fluid impacting the core (3) of the valve to the center of said core (3), thereby increasing the stability of the core (3) in the closed position of the valve (1), ensuring that it remains supported on the sealing flange (2.5).

According to FIG. 1, the first guiding segment (3.3) of the core (3) comprises a first upper surface (3.1) which is contained in a plane transverse to the axial direction X-X'. Furthermore, the second segment (3.4) of the core (3) comprises a second upper surface (3.2) which is contained in a second plane transverse to the axial direction X-X'. In particular, the mentioned first plane is located below the also mentioned second plane. In this embodiment, the segment of the core (3) close to the axis of revolution which is shown in FIG. 1 and arranged between the first upper surface (3.1) and the second upper surface (3.2) according to the axial direction X-X' is the segment which has been described as a curved segment and would be that exposed to the impact of a fluid which is fraudulently injected under pressure in an attempt to move the core (3) from its position of being supported on the sealing flange (2.5).

Figure 5:
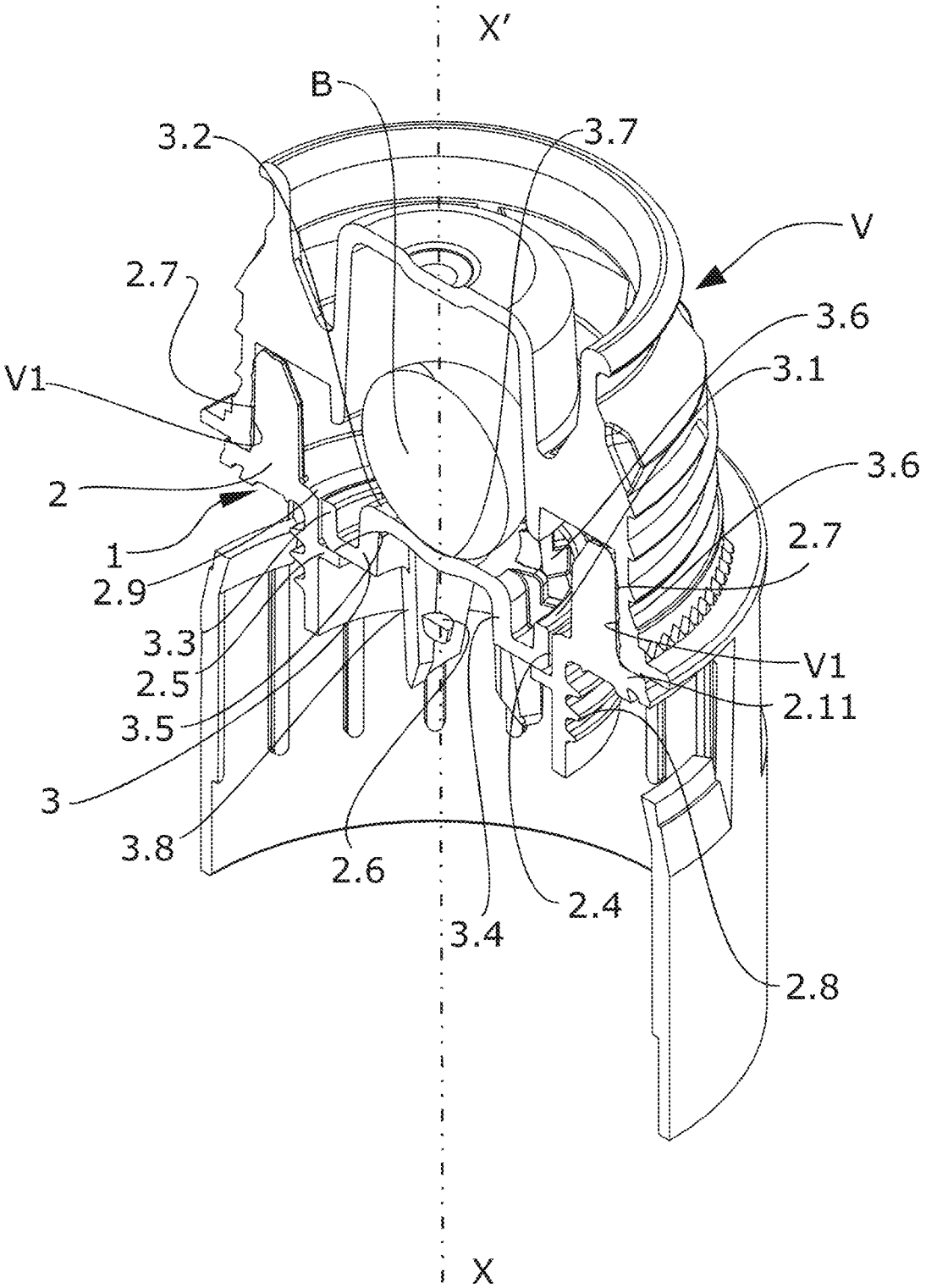
FIG. 5 This figure shows a closure for bottles comprising the valve of the embodiment of FIG. 1 according to an embodiment of the present invention.

Moreover, the valve core (3) in turn comprises in the upper part thereof a seat (3.7) as shown in FIGS. 1 and 4. This seat (3.7) is intended for receiving a ball (B) which would increase the weight exerted on the valve core (3) such that the stability of the core (3) inside the valve (1), as well as the tightness between the first cavity (2.1) and the second cavity (2.2), would be assured. In particular, FIG. 5 shows a ball (B) supported on the seat (3.7) of the valve core (3).

As seen in FIGS. 1 and 4, the valve core (3) in turn comprises a plurality of prolongations (3.8) which are oriented downwards, that is, towards the second cavity (2.2) in the closed position of the valve (1). In particular, the prolongations (3.8) are circularly distributed with respect to the axial direction X-X'. FIG. 4 shows in detail a valve core (3) with the circular distribution of four prolongations (3.8). The rotational or turning movement of these prolongations (3.8) is blocked by means of the flange (2.6) comprised in the frame (2) and arranged going through part of the second cavity (2.2). It should be noted that the flange (2.6) is seen partially sectioned in FIG. 1 but connected with the inner wall of the frame (2). By preventing the rotation of the prolongations (3.8), the valve core (3) is provided with greater stability, and therefore the possibility of a fluid going through the valve from its first cavity (2.1) to its second cavity (2.2) when the valve is in its first closed position is reduced as much as possible.

These prolongations (3.8) have a beveled end (3.8.1) which is oblique and oriented in the same circular direction which may cause a rotational force in light of the impact of the fluid when it tries to come out through the valve (1) from the lower part thereof. FIG. 4 shows in greater detail the beveled end (3.8.1) of the prolongations (3.8) of the valve core (3).

As shown in FIG. 1 and FIG. 3, the frame (2) further comprises a first outer surface (2.7) which is configured for coming into contact with the inside of the element, i.e., preferably a pourer, on which the valve (1) is coupled, according to the axial direction X-X'. The frame (2) also comprises a second outer surface (2.8) which is configured for coming into contact with the inside of a mouth of the container on which the valve (1) is coupled, particularly on which the valve is supported and establishes tightness. Lastly, the frame (2) comprises a plurality of guiding tabs (2.10) arranged in the first cavity (2.1) and spaced from one another.

Figure 2:
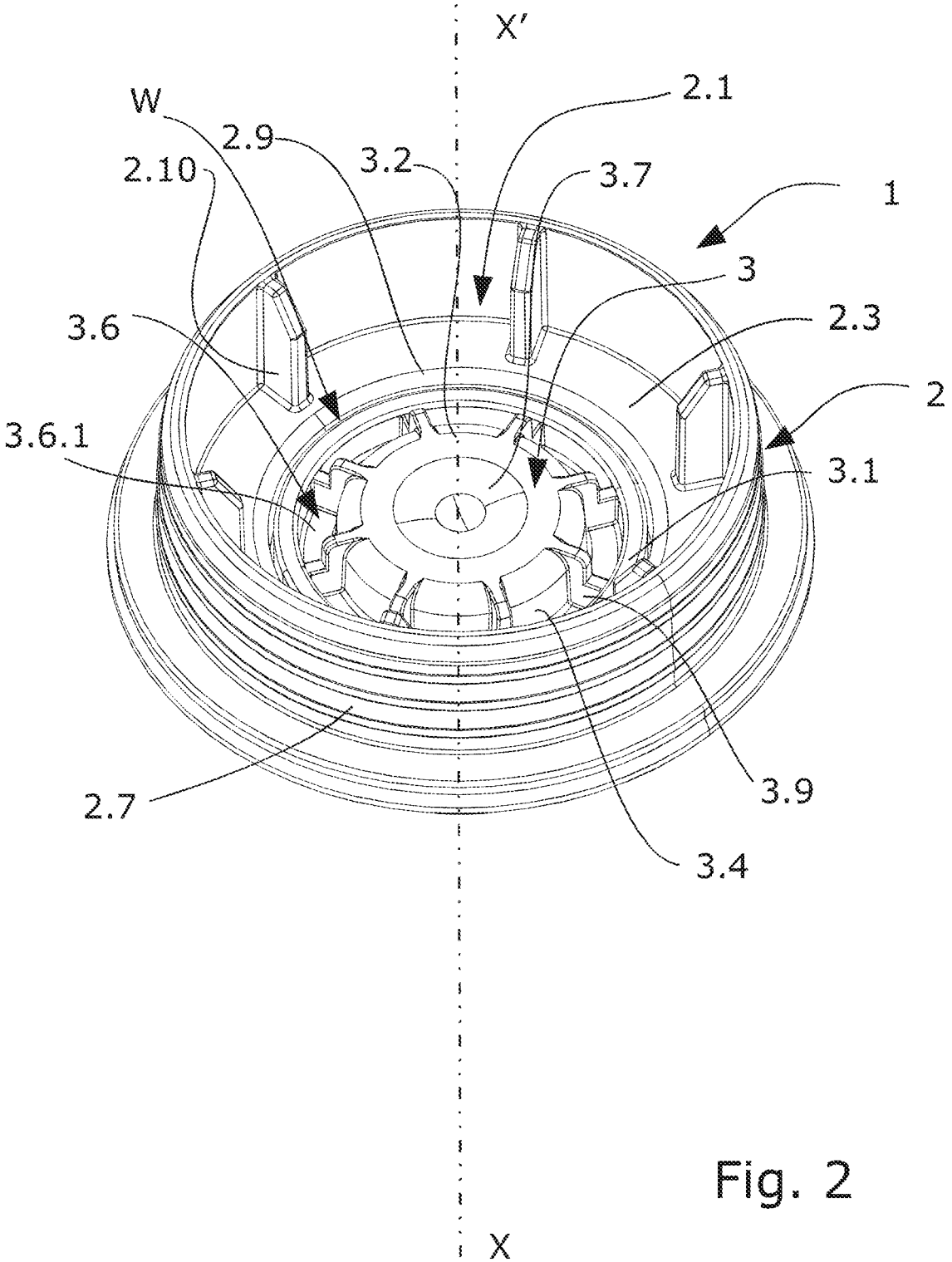
FIG. 2 This figure shows a top perspective view of the same embodiment of the valve of FIG. 1.

FIG. 2 shows a top perspective view of the valve (1) of FIG. 1, specifically a view from the upper part of the valve (1). In particular, it can be seen how the valve core (3) is accommodated inside the frame (2) and comprises a seat (3.7) on which a ball (B) (not shown in the figure) can be supported to exert weight on this same core (3). In the event that an attempt is made to introduce a fluid into the valve (1) from its upper part, this fluid would seep into the frame (2) flowing over the inner transition surface (2.3) and would continue to flow over the beveled surface (2.9) to the core (3). Part of this fluid floods the storage cavities (3.6) of the core (3) and another part impacts against the core (3) and specifically against the second guiding segment (3.4) and its curved deflector curved segment in charge of deflecting this fluid to the center of the core (3) and upwards, causing an axial force on the valve core (3) which tends to press the support seat which establishes the sealed closure. This transition of movement that the fluid would perform when an attempt is made to introduce same through the valve (1) would assure the correct position of the core (3) and the stability thereof in the first closed position of the valve (1), as well as the tightness between the first cavity (2.1) and the second cavity (2.2) of the frame (2).

FIG. 5 shows a closure for bottles comprising a pourer (V) and the valve (1) which has been described for the preceding figures, specifically in its first closed position, is coupled in the inside of the pourer (V). Unlike the valve (1) shown in FIG. 1, this one includes a ball (B) arranged on the support surface (3.7) of the valve core (3). In particular, it can be seen how the outer surface (2.7) of the frame (2) contacts an inner surface (V1) of the pourer (V). Furthermore, the frame (2) of the valve (1) comprises a circular cantilevered protrusion (2.11) concentric to the axial direction X-X'. As can be seen in FIG. 5, a portion of the body of the pourer (V) is supported on this protrusion (2.11).

The invention claimed is:

1. A valve for a pourer of containers, being configured to be coupled to a mouth of a container according to an axial direction X-X' such that, when the pourer is in an operative mode coupled to the container, a lower part is on the side next to the container and a upper part is on a side farther away from the container, said valve comprising:

a frame comprising:

a first cavity having a tubular configuration with the main axis thereof oriented according to the axial direction X-X' with a passage opening, and a second cavity having a tubular configuration with the main axis thereof oriented according to the axial direction X-X' and in communication with the first cavity through the passage opening, the second cavity comprising a cylindrical guiding surface extending according to the axial direction X-X', and a sealing flange projecting towards an inside of the second cavity;

wherein the second cavity comprises a diameter smaller than a diameter of the first cavity and both cavities are connected by means of an inner transition surface located in the first cavity;

a valve core arranged inside the frame and comprising:

a first guiding segment adapted for being housed on the guiding surface of the second cavity, and a support surface adapted for being supported on the sealing flange, the support surface adapted to establish tightness between both surfaces;

wherein the valve comprises at least two positions:

a first closed position in which a first cylindrical segment of the valve core is housed on the guiding surface of the second cavity and the support surface of the valve core is supported on the sealing flange establishing tightness between both surfaces and thereby establishing tightness between the first cavity of the frame with respect to the second cavity of the frame, and a second open position in which the support surface of the valve core is separated from the sealing flange in at least one point, giving rise to a fluid communication passage between the first cavity of the frame with respect to the second cavity of the frame;

and wherein the valve core comprises:

a configuration such that a center of gravity of the configuration is, according to the axial direction X-X' and when the valve is in the first closed position of the valve, in the second cavity and below the inner transition surface;

a second segment which is concentric with respect to the first guiding segment; and a fluid storage cavity limited according to a radial direction between the first guiding segment and the second segment and in a lower portion thereof by a base;

wherein the storage cavity is located below the inner transition surface when the valve is in the first closed position.

2. The valve according to claim 1, wherein the center of gravity of the valve core is below a plane transverse to the axial direction X-X' containing the support surface.

3. The valve according to claim 1, wherein the first guiding segment of the valve core is below the inner transition surface when the valve is in the first closed position of the valve.

4. The valve according to claim 1, wherein the first guiding segment of the valve core comprises a perimetral surface fitting snugly against the guiding surface of the frame.

5. The valve according to claim 4, wherein the valve core comprises a bevel surface between the perimetral surface and the support surface.

6. The valve according to claim 1, wherein the guiding surface is located according to the axial direction X-X' between the sealing flange and the inner transition surface of the first cavity.

7. The valve according to claim 1, wherein the first guiding segment has a configuration:

that is cylindrical, or conical, or that combines at least one cylindrical segment and at least one conical segment.

8. The valve according to claim 1, wherein the guiding surface has a configuration:

that is cylindrical, or conical, or that combines at least one cylindrical segment and at least one conical segment.

9. The valve according to claim 1, wherein the first guiding segment has a complementary configuration with respect to the guiding surface.

10. The valve according to claim 1, wherein the inner transition surface is a surface transverse to the axial direction X-X'.

11. The valve according to claim 1, wherein the second segment extends above the first guiding segment according to a curved deflector curved segment in an upward direction towards a central axis of the valve core parallel to the axial direction X-X'.

12. The valve according to claim 1, wherein the first guiding segment comprises a first upper surface contained in a first plane transverse to the axial direction X-X', and wherein the second segment comprises a second upper surface contained in a second plane transverse to the axial direction X-X', the first plane being located below the second plane.

13. The valve according to claim 1, wherein the valve core further comprises a plurality of tabs arranged in the fluid storage cavity and thereby splitting said fluid storage cavity into sectors.

14. The valve according to claim 1, wherein the valve core comprises a seat in the upper part thereof for supporting a ball intended for increasing a weight exerted on the valve core.

15. The valve according to claim 1, wherein the valve core comprises a plurality of circularly distributed, downwardly oriented prolongations.

16. The valve according to claim 15, wherein the frame comprises a flange oriented towards the inside of the second cavity adapted for being located between two prolongations of the valve core limiting a rotation thereof in order to provide greater stability to the valve core.

17. The valve according to claim 15, wherein the prolongations have beveled ends, said beveled ends being oblique and oriented in a same circular direction to cause a rotational force in light of an impact of the liquid when the liquid tries to come out through the valve from the lower part thereof.

18. The valve according to claim 1, wherein the frame further comprises a first outer surface configured for being in contact with an inside of an element on which the valve is coupled according to the axial direction X-X'.

19. The valve according to claim 1, wherein the frame further comprises a second outer surface configured for being supported on and establishing tightness with an inside of the mouth of the container.

20. The valve according to claim 1, wherein the frame further comprises a beveled surface arranged between the inner transition surface and the guiding surface.

21. The valve according to claim 1, wherein the frame further comprises a plurality of guiding tabs arranged in the first tubular cavity.

22. A closure for the valve according to claim 1.

* * * * *